United States Patent [19]

Araya et al.

[11] Patent Number: 5,010,370

[45] Date of Patent: Apr. 23, 1991

[54] TRANSFER APPARATUS AND IMAGE BEARING APPARATUS USING SAME HAVING TRANSFER MEANS FOR CONTACTING A BACKSIDE OF A TRANSFER MATERIAL

[75] Inventors: Junji Araya, Yokohama; Yukihiro Ohzeki, Kashiwa; Toshio Miyamoto, Tokyo; Koichi Hiroshima, Yokohama; Yasushi Sato; Kimio Nakahata, both of Kawasaki, all of Japan

[73] Assignee: Canon Kabushiki Kaisha, Tokyo, Japan

[21] Appl. No.: 426,002

[22] Filed: Oct. 24, 1989

[30] Foreign Application Priority Data

Oct. 29, 1988 [JP] Japan ..... 63-271990

[51] Int. Cl.[5] ..... G03G 15/16

[52] U.S. Cl. ..... 355/274; 355/271

[58] Field of Search ..... 355/274, 273, 271, 261, 355/219, 220, 221, 222, 223, 224; 430/100, 122, 126; 346/160

[56] References Cited

U.S. PATENT DOCUMENTS

| | | | |
|---|---|---|---|
| 3,937,572 | 2/1976 | Gaynor et al. | 355/217 |
| 4,326,795 | 4/1982 | Tajima et al. | 355/246 |
| 4,341,457 | 7/1982 | Nakahata et al. | 355/274 |
| 4,401,383 | 8/1983 | Suzuki et al. | 355/273 X |
| 4,402,591 | 9/1983 | Nakahata | 355/225 |
| 4,431,301 | 2/1984 | Hashimoto et al. | 355/274 |
| 4,484,811 | 11/1984 | Nakahata et al. | 355/208 |
| 4,851,960 | 7/1989 | Nakamura et al. | 355/222 X |
| 4,860,048 | 8/1989 | Itoh et al. | 355/208 |
| 4,875,063 | 10/1989 | Idenawa et al. | 346/160.1 |

FOREIGN PATENT DOCUMENTS

| | | | |
|---|---|---|---|
| 0025436 | 3/1978 | Japan | 355/217 |
| 0102967 | 6/1983 | Japan | 355/273 |
| 0194283 | 8/1988 | Japan | 355/274 |

*Primary Examiner*—Joan H. Pendegrass
*Assistant Examiner*—J. E. Barlow, Jr.
*Attorney, Agent, or Firm*—Fitzpatrick, Cella, Harper & Scinto

[57] ABSTRACT

An image transfer apparatus for transferring a toner image onto a transfer material includes an image bearing member for carrying a developed toner image; image transfer bias applying roller for contacting to a backside of the transfer material, for urging it to the image bearing member having the toner image and for applying a transfer bias to transfer the toner image to the transfer material; wherein amounts of charge applied to the transfer material by the transfer bias applying roller during its transfer operation satisfy $$A \geqq B/2$$

where A (Coulomb/cm$^2$) is an amount of the charge at a portion where a surface potential of the image bearing member is relatively low, and B (Coulomb/cm$^2$) is an amount of the charge at a portion where the surface potential of the image bearing member is relatively high. Then, disturbance to the image by the image transfer operation can be avoided.

14 Claims, 2 Drawing Sheets

TRANSFER APPARATUS AND IMAGE BEARING APPARATUS USING SAME HAVING TRANSFER MEANS FOR CONTACTING A BACKSIDE OF A TRANSFER MATERIAL

FIELD OF THE INVENTION AND RELATED ART

The present invention relates to an image forming apparatus using an electrostatic image transfer process such as electrostatic copying machine or printer, and to a transfer apparatus therefor.

In a known image forming apparatus wherein a toner image electrostatically formed on an electrostatic image bearing member such as an electrophotographic photosensitive member or an insulating member is electrostatically transferred onto a transfer material in the form of a sheet such as plain paper closely contacted thereto, it has been proposed that an image transfer member in the form of a conductive and elastic transfer roller is press-contacted to the image bearing member to form a nip therebetween through which the transfer material is passed, while the transfer roller is being supplied with a bias voltage having a polarity opposite to that of the charged toner used for the development.

The image forming apparatus of this type is advantageous over the conventional apparatus using a known corona discharger as the image transfer means, in that the transfer bias voltage is far lower, that corona production such as ozone nitride is not produced, and in that the transfer material can be conveyed stably.

However, it involves some drawbacks. In the apparatus of this type, the transfer material is advanced through the nip formed between the image bearing member and the transfer roller at the image transfer position where the transfer roller is press-contacted to the image bearing member, and the electric charge is directly applied to the back side of the transfer material by the bias voltage applied to the transfer roller. The amount of charge actually applied to the transfer material significantly depends on the surface potentials of the image bearing member at the light and dark positions, in other words, the image portion and the non-image portion. This has been found through the experiments by the inventors.

The reason for this is considered to be the contrast, that is, the difference between the transfer bias applied to the transfer roller and the image bearing member surface potential, is larger in the nonimage portion than in the image portion (in the case of a negative or reverse development). Therefore, the amount of the charge applied to the backside of the transfer material is larger in the non-image portion than in the image portion.

The transfer material having passed through the transfer position is, therefore, electrically charged by the application of the transfer bias. If it is excessively charged, an electric field tending to shift the toner from the image portion to the non-image portion is produced. Particularly when the transfer material is separated from the image bearing member, the toner in the image portion is scattered to the background or non-image portion with the result a smeared image, or remarkably contaminated background. It has empirically been confirmed that the above is particularly remarkable under low humidity conditions. The reason would be that under such conditions, the electric resistance of the transfer material is so high that the electric charge does not move during the image transfer action on the transfer material, with the result of a larger potential difference between the image portion and the non-image portion.

SUMMARY OF THE INVENTION

Accordingly, it is a principal object of the present invention to provide an image transfer apparatus and an image forming apparatus using the same, wherein the transfer apparatus is provided with a transfer member press-contacted to the image bearing member, wherein the amount of charge applied to the image portion of the transfer material and that applied to the non-image portion satisfy a particular condition, by which the image can be transferred without the above-described drawbacks.

According to an aspect of the present invention, there is provided an image transfer apparatus for transferring a toner image onto a transfer material, comprising an image bearing member for carrying a developed toner image; image transfer bias applying means for contacting to a backside of the transfer material, for urging it to said image bearing member having the toner image and for applying a transfer bias to transfer the toner image to the transfer material; wherein amounts of charge applied to the transfer material by said transfer bias applying means during its transfer operation satisfy $$A \gtrsim B/2$$

where A (Coulomb/cm$^2$) is an amount of the charge at a portion where a surface potential of said image bearing member is relatively low, and B (Coulomb/cm$^2$) is an amount of the charge at a portion where the surface potential of said image bearing member is relatively high.

According to another aspect of the present invention, there is provided an image forming apparatus, comprising an image bearing member; latent image forming means for forming an electrostatic latent image on said image bearing member; developing means for developing an electrostatic latent image formed on said image bearing member; transfer means for contacting to a backside of the transfer material, for urging it to said image bearing member having the toner image and for applying a transfer bias to transfer the toner image to the transfer material, where the amount of electric charge applied to the transfer material by said transfer bias applying means during its transfer operation satisfy $$A \gtrsim B/2$$

where A (Coulomb/cm$^2$) is an amount of the charge at a portion where a surface potential of said image bearing member is relatively low, and B (Coulomb/cm$^2$) is an amount of the charge at a portion where the surface potential of said image bearing member is relatively high.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
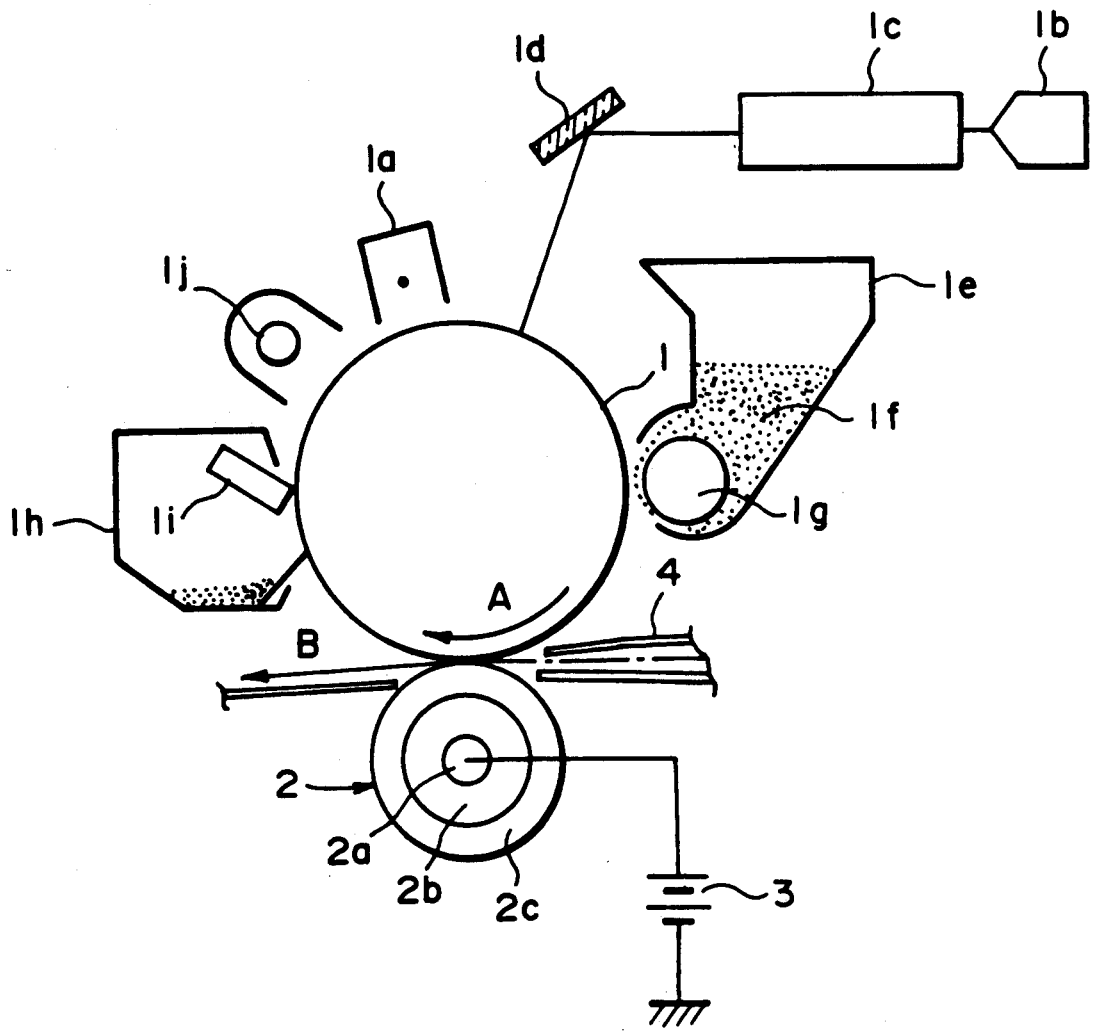
FIG. 1 is a cross sectional view of an image forming apparatus suitable for incorporating the present invention.

Referring to FIG. 1, there is shown a laser beam printer as an exemplary image forming apparatus suitable for the present invention. The apparatus includes an electrophotographic photosensitive member 1 in the form of a cylinder rotatable in the direction indicated by an arrow A. The axis thereof extends perpendicularly to the sheet of the drawing. An electrically conductive and elastic transfer roller 2 is press-contacted to the photosensitive member 1 to form an image transfer position. When the toner image on the surface of the photosensitive member 1 reaches the transfer position with rotation of the photosensitive member 1, a transfer material (not shown) is conveyed in the direction indicated by an arrow B from a conveying passage 4 in timed relation with the arrival of the toner image to the transfer position. By the action of the transfer bias applied to the transfer roller 2 by a power source 3, the toner image is transferred from the photosensitive member to the transfer material.

After the completion of the image transfer operation, the transfer material now carrying the toner image is further advanced in the direction B to reach an unshown image fixing station.

Around the photosensitive member 1, there are disposed a primary charger 1*a* for uniformly charging the surface of the photosensitive member 1, image information writing means for writing information on the charged surface, developing means 1*e* for forming a toner image by supplying toner 1*f* to the latent image by a developing roller 1*g*, cleaning means 1*h* for removing residual toner by a blade 1*i* and for removing residual electric charge, charge removing lamp 1*j* and other means necessary for the image formation. The image information writing means includes a semiconductor laser source 1*b* for producing a laser beam imagewisely modulated, a polygonal mirror 1*c* and a reflection mirror 1*d*.

The image forming apparatus will further be described. The photosensitive member 1 is an organic photoconductor (OPC) photosensitive member having a diameter of 30 mm. This is electrically charged to −700 V by the primary charger 1*a*. The charged photosensitive member 1 is exposed to the image information by scanningly deflecting the modulated laser beam, by which the potential of the photosensitive member is reduced to −100 V at the portion where it is exposed to the laser beam, whereby an electrostatic latent image is formed.

Then, negative toner (electrically charged to a negative polarity) is supplied from the developing device to form a toner image on the surface of the photosensitive member 1 corresponding to the latent image, through a reverse development.

When the transfer material comes to the transfer position, a positive transfer bias is applied to the backside of the transfer material from the power source 3 by the transfer roller 2, by which the toner image is transferred to the transfer material.

The transfer roller 2 comprises a core metal 2*a* having a diameter of 6 mm, an inside layer 2*b* thereon made of EPDM rubber (terpolymer of ethylenepropylene dien) having a volume resistivity of approximately $10^5$ ohm.cm, and an outside layer 2*c* thereon made of PVDF (polyvinylidene fluoride) having a thickness of 200 microns and a volume resistivity $10^{11}$ ohm.cm. The outer diameter of the transfer roller 2 is 17 mm.

Figure 2:
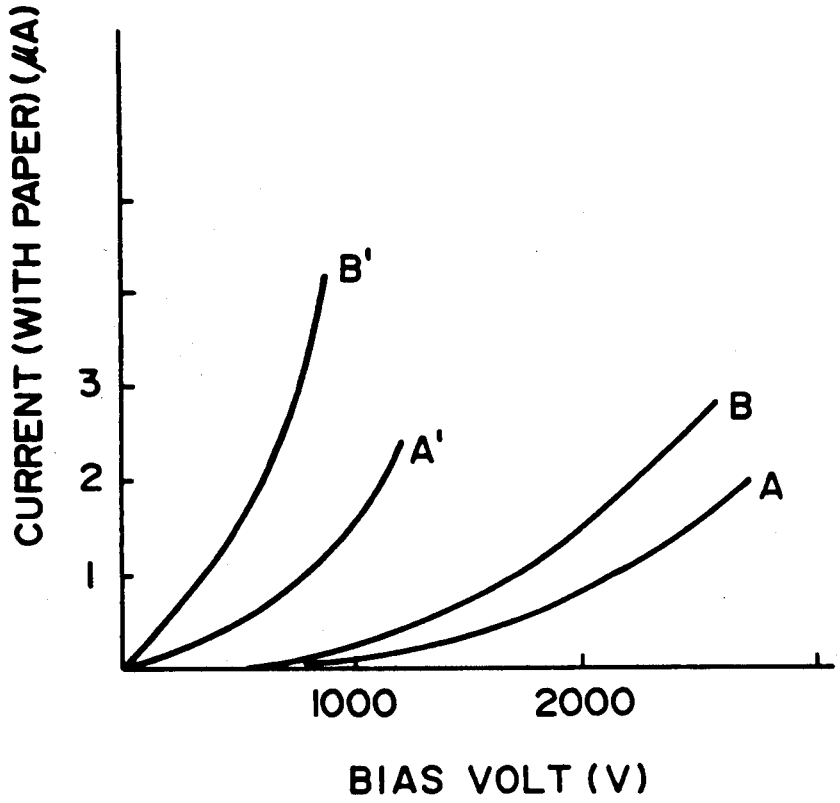
FIG. 2 is a graph of a bias voltage applied to the transfer roller vs. the current flowing during the sheet being in the nip.

FIG. 2 is a plot of a current flowing between the core metal 2*a* of the transfer roller 2 and the power source 3 vs. a bias voltage applied to the transfer roller when A4 size (Japanese Industrial Standard) transfer sheet having a width of 21 cm is longitudinally advanced at a speed of 2.4 cm/sec. A curve A shows the current when the sheet having a solid black image is passed through the nip of the transfer position, whereas a curve B shows the current when the sheet having an entirely white image is passed through the nip.

An optimum transfer efficiency which was not less than 70%, further preferably not less than 80% was provided when the current for the solid black image was 0.5–1.0 micro-ampere.

For example, when the bias voltage is 2000 V the current for the solid black image between the transfer bias voltage source and the core metal of the transfer roller is 0.8 micro-ampere, with which the image transfer operation is satisfactory, and the current for the entirely white image is 1.5 micro-ampere.

By this, the electric charge of 0.030 microCoulomb/cm$^2$ (=0.8/(2.4 =transfer material moving speed))×21 (width of the transfer material) is applied to the backside of the image portion, and the electric charge of 0.016 micro-Coulomb/cm$^2$ (1.5/(2.4×21)) is applied to the backside of the transfer material in the non-image portion. With these conditions, no toner is scattered from the image portion to the non-image portion.

For the purpose of comparison, similar experiments have been carried out using a low resistance roller by removing the outside layer made of PVDF having the high electric resistance, from the above-described transfer roller 2. The results are shown in FIG. 2 by the curves A′ and B′.

When the bias voltage is 700 V, the current is 0.8 micro-ampere for the solid black image, by which the image transfer operation is satisfactory. However, as for the entirely white image, the current is 2.5 microamperes, with the result of a large difference in the electric charge applied to the image portion and the non-image portion, so that the toner is scattered from the image portion to the non-image portion.

The amount of charge applied to the backside of the transfer material is varied in the image portion and the non-image portion, and the image qualities and the degree of the toner scattering are evaluated. The results are shown in the following Table.

TABLE

| Charge amount in image portion ($\mu$C/cm$^2$) | Charge amount of non-image portion ($\mu$C/cm$^2$) | Toner scattering |
|---|---|---|
| 0.01 | 0.04 | NG |
| 0.01 | 0.03 | NG |
| 0.01 | 0.025 | NG |
| 0.01 | 0.02 | F |
| 0.01 | 0.017 | G |
| 0.01 | 0.014 | G |
| 0.02 | 0.08 | NG |
| 0.02 | 0.06 | NG |
| 0.02 | 0.05 | NG |
| 0.02 | 0.04 | F |
| 0.02 | 0.03 | G |

TABLE-continued

| Charge amount in image portion ($\mu C/cm^2$) | Charge amount of non-image portion ($\mu C/cm^2$) | Toner scattering |
|---|---|---|
| 0.02 | 0.025 | G |

G: Image quality is good without toner scattering.
F: Toner is slightly scattered, but no practical problem.
NG: Toner is scattered to such an extent that the scattered toner is observed by eyes, and therefore, the image quality is remarkably deteriorated.

From the above, good images without toner scattering can be provided, if the following is satisfied:

$$A \geqq B/2$$

where A is the amount of electric charge applied to the backside of the transfer material in the image portion (Coulomb/$cm^2$); and B is that at the non-image portion.

It has also been found that the volume resistivity of the outside layer of the transfer roller is preferably between $10^9$-$10^{13}$ ohm.cm, and that the transfer bias is 1500 V-3000 V.

Figure 3:
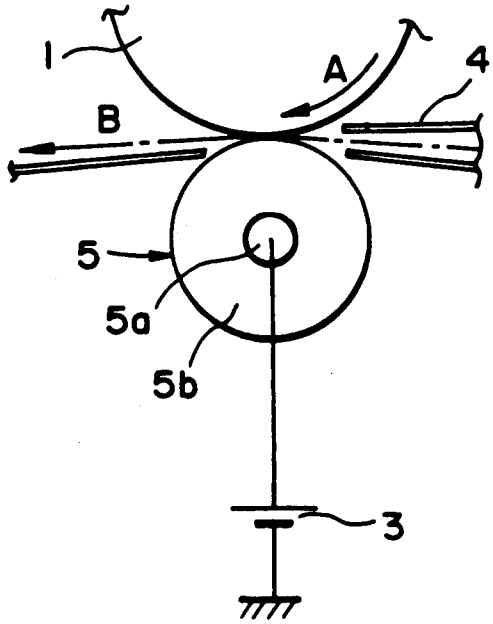
FIG. 3 is a sectional view of another image forming apparatus suitable for the present invention.

FIG. 3 shows another embodiment, wherein the photosensitive member 1 is the same as in the foregoing embodiment. The transfer roller 5 includes a core metal 5*a* having a diameter of 6 mm and a conductive urethane coating 5*b* having a resistivity of $10^{10}$ ohm.cm, wherein the overall outer diameter is 17 mm.

With this structure, the transfer bias is selected to be 2500 V. Then, the current when the transfer sheet having the solid black image was in the nip was 0.6 microampere, and the current when the sheet having the entirely white image was 1.0 microampere. The above-described requirement of $A \geqq B/2$ was satisfied between the charge amount A at the image portion and the charge amount at the non-image portion, and it was confirmed that the toner did not scatter from the image portion to the non-image portion.

In the case of this transfer roller, the good results were obtained when the resistivity of the conductive outside layer of the transfer roller was $10^8-10^{12}$ ohm.cm, and the transfer bias was 1800 V-3500 V.

In the foregoing embodiment, the transfer means is in the form of a transfer roller. The roller may be driven by driving means for the roller, or it may be rotated by the photosensitive drum.

Other possible forms of the transfer means are a belt, a brush which does not rotate or move, or a soft contacting and rubbing member having electric conductivity or having a low resistance.

In the foregoing embodiment, the description is made as to the reverse development. However, the present invention is applicable to a normal or positive development wherein the toner is deposited in the latent image portion. In this case, the charge amounts at the image portion where the toner is deposited on the latent image and at the non-image portion not having the toner, satisfy the above-described requirement.

As for the image forming apparatus, it may be a copying machine wherein light reflected by an original is projected onto the photosensitive member.

As described in the foregoing, the electric currents through the contact type transfer means at the portion where the surface potential of the electrostatic latent image after the development is relatively high and the portion where it is low, satisfy the above. By doing so, it can be avoided that the charge amounts of the transfer material are excessively different between the high potential portion and the low potential portion. Therefore, unpreferable movement of the toner can be avoided when the transfer material is separated.

Therefore, the image quality can be improved.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:
an image bearing member;
latent image forming means for forming an electrostatic latent image on said image bearing member;
developing means for developing an electrostatic latent image formed on said image bearing member into a toner image with toner;
transfer means for contacting a backside of the transfer material, for urging the transfer material to said image bearing member having the toner image and for applying a transfer bias to transfer the toner image to the transfer material;
wherein amounts of electric charge applied to the transfer material by said transfer means during a transfer operation satisfy the relation:

$$A \geqq B/2$$

where A is an amount of the charge at a portion of the transfer material where the toner is present, and B is an amount of the charge at a portion of the transfer material where the toner is absent.

2. An apparatus according to claim 1, wherein said transfer means includes an elastic roller electrode.

3. An apparatus according to claim 1, wherein said image bearing member is an electrophotographic photosensitive member.

4. An apparatus according to claim 1, wherein said image bearing member is an electrophotographic photosensitive member, and wherein said latent image forming means includes charging means for uniformly charging said image bearing member and means for applying light information to said image bearing member.

5. An image forming apparatus, comprising:
an image bearing member;
means for forming an electrostatic latent image on said image bearing member;
developing means for reverse-developing the electrostatic latent image on said image bearing member;
transfer means for contacting a backside of the transfer material, for urging the transfer material to said image bearing member having the toner image and for applying a transfer bias to transfer the toner image to the transfer material;
wherein amounts of electric charge applied to the transfer material by said transfer means during a transfer operation satisfy the relation:

$$A \geqq B/2$$

where A is an amount of the charge at a portion of the transfer material where the toner is present, and B is an amount of the charge at a portion of the transfer material where the toner is absent.

6. An apparatus according to claim 5, wherein said transfer means includes an elastic roller electrode.

7. An apparatus according to claim 5, wherein said image bearing member is an electrophotographic photosensitive member, wherein said latent image forming means includes charging means for uniformly charging said image bearing member and means for applying light information to said image bearing member.

8. An image transfer apparatus, comprising:

an image bearing member for carrying a developed toner image;

transfer means for contacting a backside of the transfer material, for urging the transfer material to said image bearing member having the toner image and for applying a transfer bias to transfer the toner image to the transfer material;

wherein amounts of charge applied to the transfer material by said transfer means during a transfer operation satisfy the relation:

$$A \geqq B/2$$

where A is an amount of the charge at a portion of the transfer material where the toner is present and where a potential difference between a potential applied to said transfer means and a surface potential of said image bearing member is relatively low, and B is an amount of the charge at a portion where the difference between a potential applied to said transfer means and a surface potential of said image bearing member is relatively high.

9. An apparatus according to claim 8, wherein said transfer means includes an elastic roller electrode.

10. An apparatus according to claim 8, wherein the toner image is produced by reverse development of an electrostatic latent image on said image bearing member.

11. An apparatus according to claim 10, further comprising latent image forming means for forming a latent image on said image bearing member and developing means for developing the latent image into the toner image with the toner, wherein the latent image has the same polarity as the toner.

12. An apparatus according to claim 1, 5 or 8 wherein said transfer means has a layer having a volume resistivity of $10^8$-$10^{12}$ ohm. cm.

13. An operating apparatus according to claim 2, 6 or 9, wherein said roller electrode has a volume resistivity of $10^8$-$10^{12}$ cm.

14. An apparatus according to claim 5, wherein the latent image is of the same polarity as the toner.

* * * * *

UNITED STATES PATENT AND TRADEMARK OFFICE

CERTIFICATE OF CORRECTION

PATENT NO. : 5,010,370

DATED : April 23, 1991

INVENTOR(S) : JUNJI ARAYA, ET AL.

It is certified that error appears in the above-identified patent and that said Letters Patent is hereby corrected as shown below:

On the title page:

IN [54] TITLE

"SAME" should read --SAME,--

COLUMN 1

Line 2, "SAME" should read --SAME,--.

COLUMN 2

Line 66, "cross sectional" should read --cross-sectional--.

COLUMN 8

Claim 13, line 20, "operating" should be deleted.
Claim 13, line 22, "$10^{-8}$-$10^{-12}$ cm." should read --$10^{-8}$-$10^{-12}$ ohm.cm.--

Signed and Sealed this

Twenty-ninth Day of December, 1992

*Attest:*

DOUGLAS B. COMER

*Attesting Officer*

*Acting Commissioner of Patents and Trademarks*